US011769611B2

(12) United States Patent
Sjöberg et al.

(10) Patent No.: US 11,769,611 B2
(45) Date of Patent: Sep. 26, 2023

(54) SEALING ARRANGEMENT FOR A BUSHING AND A BUSHING WITH SUCH A SEALING ARRANGEMENT

(71) Applicant: HITACHI ENERGY SWITZERLAND AG, Baden (CH)

(72) Inventors: Claes Peter Sjöberg, Ludvika (SE); Natalia Gutman, Ludvika (SE); Danan Yao, Hefei (CN); Peirong Cai, Hefei (CN)

(73) Assignee: Hitachi Energy Switzerland AG, Baden (CH)

( * ) Notice: Subject to any disclaimer, the term of this patent is extended or adjusted under 35 U.S.C. 154(b) by 723 days.

(21) Appl. No.: 16/964,328

(22) PCT Filed: Jan. 23, 2018

(86) PCT No.: PCT/CN2018/073875

§ 371 (c)(1),
(2) Date: Jul. 23, 2020

(87) PCT Pub. No.: WO2019/144293

PCT Pub. Date: Aug. 1, 2019

(65) Prior Publication Data

US 2021/0043339 A1 Feb. 11, 2021

(51) Int. Cl.
*H01B 17/30* (2006.01)
*H01F 27/04* (2006.01)

(52) U.S. Cl.
CPC ..... *H01B 17/301* (2013.01); *H01F 27/04* (2013.01)

(58) Field of Classification Search
CPC ..... H01B 17/301; H01B 17/308; H01F 27/04
See application file for complete search history.

(56) References Cited

U.S. PATENT DOCUMENTS 3,681,739 A * 8/1972 Kornick ..... H01R 24/40 439/314
3,816,641 A * 6/1974 Iversen ..... H01R 13/523 174/76

(Continued)

FOREIGN PATENT DOCUMENTS

AT 518819 A1 1/2018
CN 2110274 U 7/1992

(Continued)

OTHER PUBLICATIONS

European Patent Office, Office Action for European Patent No. 18902914.3, dated Oct. 28, 2022, 6 pages.

(Continued)

*Primary Examiner* — Sherman Ng
(74) *Attorney, Agent, or Firm* — Sage Patent Group

(57) ABSTRACT

Embodiments of the present disclosure relate to a sealing arrangement of a bushing for a power electrical device and a bushing comprising the sealing arrangement. The sealing arrangement includes a top cover; a central conductor going through the top cover; a guide element having a cylinder portion and a flange portion extended from a middle part of the cylinder portion, wherein the cylinder portion is arranged between the top cover and the central conductor, and the flange portion is connected onto the top cover; a static sealing structure provided between the guide element and the top cover; and a dynamic sealing structure provided between the guide element and the central conductor. With the new sealing structure design, it could provide a good sealing performance so that the bushing can be used in various environments.

17 Claims, 3 Drawing Sheets

(56) References Cited

U.S. PATENT DOCUMENTS

| | | | | | |
|---|---|---|---|---|---|
| 3,847,463 | A * | 11/1974 | Hayward | C07C 17/208 | 439/578 |
| 4,225,162 | A * | 9/1980 | Dola | F16L 33/26 | 285/251 |
| 4,730,231 | A * | 3/1988 | Tanigaki | H02B 11/26 | 361/612 |
| 2013/0118803 | A1 * | 5/2013 | Magno, Jr. | H02G 15/013 | 264/494 |

FOREIGN PATENT DOCUMENTS

| | | | |
|---|---|---|---|
| CN | 2297784 | Y | 11/1998 |
| CN | 201374231 | Y | 12/2009 |
| CN | 201622917 | U | 11/2010 |
| CN | 201886877 | U | 6/2011 |
| CN | 202332543 | U | 7/2012 |
| CN | 202454408 | U | 9/2012 |
| CN | 202473559 | U | 10/2012 |
| CN | 202487378 | U | 10/2012 |
| CN | 202632996 | U | 12/2012 |
| CN | 203481011 | U | 3/2014 |
| CN | 203812702 | U | 9/2014 |
| CN | 203871156 | U | 10/2014 |
| CN | 203983004 | U | 12/2014 |
| CN | 204632476 | U | 9/2015 |
| CN | 205789452 | U | 12/2016 |
| DE | 2009264 | A1 | 9/1971 |
| DE | 3613569 | A1 | 10/1986 |
| DE | 9012338 | U1 | 1/1991 |
| EP | 03273452 | A1 | 1/2018 |
| FR | 1493532 | S | 9/1967 |
| FR | 2582143 | A1 | 11/1986 |
| GB | 991546 | A | 5/1965 |

OTHER PUBLICATIONS

Korean Intellectual Property Office, Decision for Grant of Patent, Korean Patent No. 10-2020-7021293, dated Apr. 13, 2022, 3 pages.

European Patent Office, Extended European Search Report for European Patent Application No. 18902914.3, dated Jul. 9, 2021, 8 pages.

Chinese Office Action, Chinese Patent Application No. 2018800880667, dated Feb. 24, 2023, 3 pages.

International Search Report and Written Opinion of the International Searching Authority, PCT/CN2018/073875, dated Oct. 26, 2018, 8 pages.

* cited by examiner

SEALING ARRANGEMENT FOR A BUSHING AND A BUSHING WITH SUCH A SEALING ARRANGEMENT

CROSS REFERENCE TO RELATED APPLICATIONS

This application is a 35 U.S.C. § 371 national stage application of PCT International Application No. PCT/CN2018/073875 filed on Jan. 23, 2018, the disclosure and content of which is incorporated by reference herein in its entirety.

FIELD OF THE INVENTION

The non-limiting and exemplary embodiments of the present disclosure generally relate to the field of bushings, and more particularly relate to a sealing arrangement for a bushing and a bushing with such a sealing arrangement.

BACKGROUND OF THE INVENTION

With the development of transmission grid, requirements of the transformer capacity for power transformers increase constantly. As a critical component for power transformer, the high voltage transformer bushing is required to have a high current class so that it is reliable enough during its lifetime to ensure the security of the transformer and power grid. The cable lead bushing does not meet these requirements, and therefore more bushings are used with the central conductor.

For a bushing in service, a length of components of the bushing might change due to temperature changes. Normally, the larger the current of the bushing is, the higher the temperature rises, and due to the thermal expansion and contraction of conductor, the central conductor will change in the length. In addition, the length of a conductor also increases with the temperature rise during the daytime and decreases with the temperature fall during the night. Thus, a periodic temperature change may occur during a day. The similar change might occur due to seasonal temperature variations as well. Those changes in the length of the conductor will in turn cause a relative movement between internal central conductor and the sealing element. Such a relative movement would cause wear, especial wear of the sealing element due to an impact of tension load.

For now, there are mainly two types of sealing methods to deal with the thermal expansion and contraction of the central conductor in the market. One is to use a simple dynamic sealing system and the other is to apply a multi-contact and static system. However, none of these solutions is effective enough to deal with the thermal expansion and contraction as well as the sealing problems.

Therefore, in the art there is a need for a new sealing arrangement for bushing.

SUMMARY OF THE INVENTION

Various embodiments of the present disclosure mainly aim at providing a solution for a sealing arrangement for bushing to solve or at least partially mitigate at least a part of problems in the prior art. Other features and advantages of embodiments of the present disclosure will also be understood from the following description of specific embodiments when read in conjunction with the accompanying drawings, which illustrate, by way of example, the principles of embodiments of the present disclosure.

According to a first aspect of the present disclosure, there is provided a sealing arrangement of a bushing for a power electrical device. The sealing arrangement may comprise a top cover; a central conductor going through the top cover; a guide element having a cylinder portion and a flange portion extended from a middle part of the cylinder portion, wherein the cylinder portion is arranged between the top cover and the central conductor, and the flange portion is connected onto the top cover; a static sealing structure provided between the guide element and the top cover; and a dynamic sealing structure provided between the guide element and the central conductor.

In an embodiment of the present disclosure, the dynamic sealing structure may comprise at least one dynamic sealing O-ring between the guide element and the central conductor.

In another embodiment of the present disclosure, the dynamic sealing structure may comprise at least one dynamic sealing O-ring between the guide element and the central conductor.

In a further embodiment of the present disclosure, the at least one dynamic sealing O-ring may be made of fluorine silicone rubber.

In a still further embodiment of the present disclosure, the dynamic sealing structure may further comprise a wear ring arranged between the guide element and the central conductor.

In a yet further embodiment of the present disclosure, the at least one dynamic sealing O-ring may comprise two dynamic sealing O-rings, and wherein the wearing ring may be arranged between the two dynamic sealing O-rings.

In another embodiment of the present disclosure, the wear ring may be made of poly tetra fluoroethylene.

In a further embodiment of the present disclosure, the dynamic sealing structure (230) may further comprise a wiper ring arranged between the guide element and the central conductor, at an upper portion of the guide element.

In a still further embodiment of the present disclosure, the wiper ring may be made of polyurethane.

In yet further embodiment of the present disclosure, the sealing arrangement may comprise a protective cap covering a top portion of the guide element to protect the sealing arrangement from an external environment and wherein the central conductor goes through the protective cap.

In another embodiment of the present disclosure, the sealing arrangement may further comprise a further O-ring arranged between the protection cap and the central conductor.

In a further embodiment of the present disclosure, the further O-ring may be made of chloroprene rubber (CR).

In another embodiment of the present disclosure, the central conductor may have a chrome-plating surface.

In another embodiment of the present disclosure, the guide element may have an anodic oxidation surface.

In another embodiment of the present disclosure, the static sealing element may comprise a static sealing O-ring and a gasket arranged between the guide element and the top cover and wherein one or both of the static sealing O-ring and a gasket is made of nitrile butadiene rubber (NBR).

In another embodiment of the present disclosure, there is further provided a bushing comprising a sealing arrangement for the bushing according to any of the first aspect.

In a further embodiment of the present disclosure, the bushing is a transformer bushing, especially, an oil-immersed paper transformer bushing.

With the new sealing structure design, it could provide a good sealing performance so that the bushing can be used in various environments. Specially, the dynamic structure could provide a good sealing performance. The wear ring could provide good anti-eccentricity and anti-wear properties. Chrome-planting on copper conductor surface can effectively prevent the copper conductor from abrasion. Anodic oxidation for guide's face can effectively prevent electrochemical corrosion between copper and aluminum, and meanwhile, the anodic oxide planting of aluminum has an insulating effect, it can effectively prevent the virtual connection and unnecessary diversion circuit. The entire sealing system may be further protected by a protection cap, which can effectively prevent the sliding sealing structure from dust, rain and snow erosion. In addition, the adoption of new structures does not increase the cost significantly or cause any substantial complexity.

BRIEF DESCRIPTION OF THE DRAWINGS

The above and other aspects, features, and benefits of various embodiments of the present disclosure will become more fully apparent, by way of example, from the following detailed description with reference to the accompanying drawings, in which like reference numerals or signs are used to designate like or equivalent elements. The drawings are illustrated for facilitating better understanding of the embodiments of the disclosure and not necessarily drawn to scale, in which.

DETAILED DESCRIPTION OF EMBODIMENTS

Figure 1:
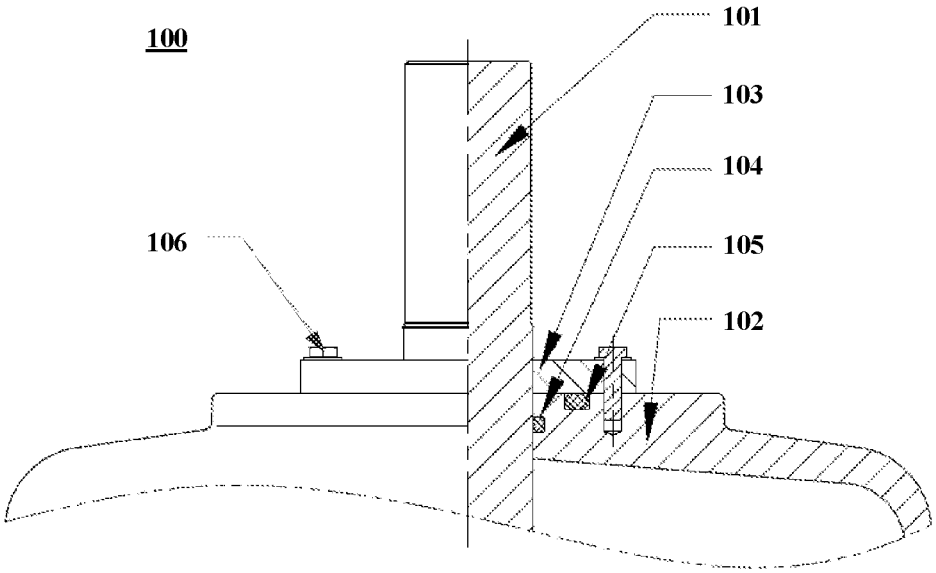
FIG. 1 schematically illustrates a sealing arrangement for transformer bushing in the prior art.

Hereinafter, the principle and spirit of the present disclosure will be described with reference to illustrative embodiments. It shall be understood, all these embodiments are given merely for one skilled in the art to better understand and further practice the present disclosure, but not for limiting the scope of the present disclosure. For example, features illustrated or described as part of one embodiment may be used with another embodiment to yield still a further embodiment. In the interest of clarity, not all features of an actual implementation are described in this specification.

References in the specification to "one embodiment," "an embodiment," "an example embodiment," etc. indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

It shall be understood that, although the terms "first" and "second" etc. may be used herein to describe various elements, these elements should not be limited by these terms. These terms are only used to distinguish one element from another. For example, a first element could be termed a second element, and similarly, a second element could be termed a first element, without departing from the scope of example embodiments. As used herein, the term "and/or" includes any and all combinations of one or more of the associated listed terms.

The terminology used herein is for the purpose of describing particular embodiments only and is not intended to be liming of example embodiments. As used herein, the singular forms "a", "an" and "the" are intended to include the plural forms as well, unless the context clearly indicates otherwise. It will be further understood that the terms "comprises", "comprising", "has", "having", "includes" and/or "including", when used herein, specify the presence of stated features, elements, and/or components etc., but do not preclude the presence or addition of one or more other features, elements, components and/or combinations thereof. It will be also understood that the terms "connect (s)," "connecting", "connected", etc. when used herein, just means that there is an electrical connection between two elements and they can be connected either directly or indirectly, unless explicitly stated to the contrary.

In the following description and claims, unless defined otherwise, all technical and scientific terms used herein have the same meaning as commonly understood by one of ordinary skills in the art to which this disclosure belongs.

As mentioned in Background, the bushing conductor temperature will rise when the bushing is in service, and the ambient temperature of the bushing may also change, all of which cause changes in the length of conductor in service. Currently, there are mainly two common types of top structure systems for the transformer bushing. One is to use a simple dynamic sealing system, and other is to use a multi-contact and static system.

As to the first type of top structure system, there are many similar bushings available in the market, but they all use a simple top sealing structure which is unreliable enough. For illustrative purposes, description will be first made to FIG. 1 to briefly introduce an existing sealing arrangement, wherein FIG. 1 illustrates an example sealing arrangement for transformer bushing in the prior art.

As illustrated in FIG. 1, the transformer bushing 100 includes a central conductor 101, a top chamber 102 (only a part thereof is illustrated), a cover plant 103 and a dynamic sealing system including a first O-ring 104 and a second O-ring 105. The central conductor 101 is used to transfer high-voltage power. The central conductor 101 goes through the top chamber 102 and enters the bushing. The top chamber 102 is the top portion of the bushing oil chamber, in which insulation liquid such as oil is filed. The central conductor 101 also goes through the cover plate 103, which is connected onto the top cover by bolts 106. The first O-ring 104 is arranged between the central conductor 101 and the top chamber 102, and the second O-ring 105 is arranged between the top chamber 102 and the cover plate (103). The first O-ring 104 forms a dynamical sealing system and the second O-ring 105 forms a static sealing system. The contraction of the central conductor can be adjusted by the dynamic sealing structure so as to reduce the risk of leakage. However, such a dynamical top sealing structure is too simple to provide enough reliability and thus it still has a risk of oil leakage.

On the other hand, the multi-contact and static system uses multiple contacts to form a sealing structure, which means a quite complex structure. Such a system not only increases the cost of production but also fails to reduce wear of sealing rings and conductors as well.

In addition, the traditional structure systems also have many other problems. As an example, the central conductor will be eccentric when the outer terminal of the bushing is subjected to a lateral force or when the outer wire is subjected to a wind force. As another example, an electrochemical corrosion might exist between different metal sealing surface due to lack of protection for the sealing system. These problems have a great negative effect on the sealing performance of the sealing ring and also increase the risk of internal oil leakage.

To this end, the present invention provides a new-type sealing arrangement of the bushing for a power electrical device to address or at least mitigate at least one of problems mentioned above. Hereinafter, reference will be made to FIG. 2 to 5 to describe example sealing arrangements for a transformer according to embodiments of the present disclosure. It shall be appreciated that the example sealing arrangements are only given to illustrate the principle of the tying device proposed herein and the present disclosure is not limited thereto. In fact, it is also possible to make modifications, deletion, addition or alteration to the solution as disclosed herein without departing the spirit of the present disclosure as taught herein. In addition, the bushing can be a transformer bushing, a wall bushing, or any other type of bushing for a power electrical device that is required to be insulated. In addition, the bushing can be a dry-type bushing or a liquid-filled bushing.

Figure 2:
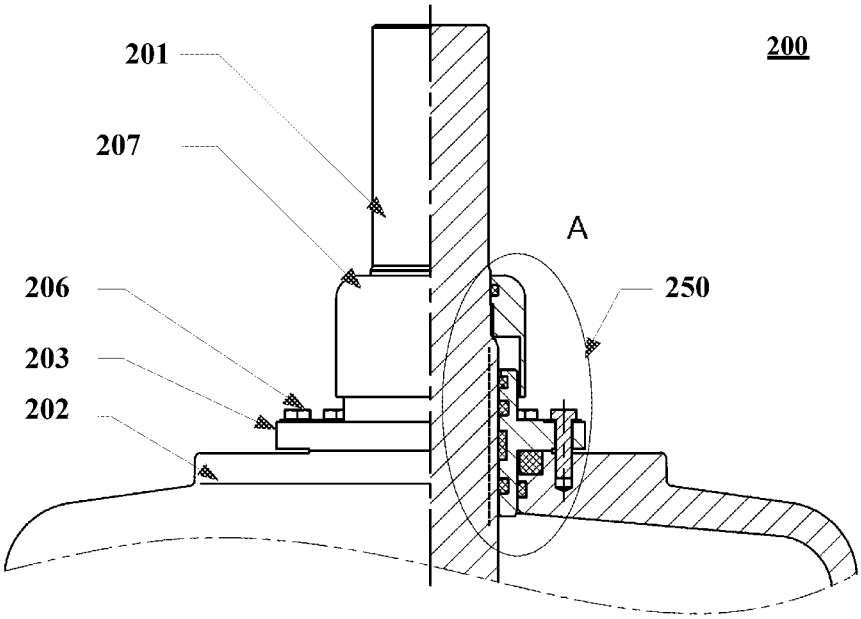
FIG. 2 schematically illustrates a sealing arrangement for a bushing according to an embodiment of the present disclosure.

Reference is made to FIG. 2, which schematically illustrates a diagram of an example sealing arrangement for transformer bushing according to an embodiment of the present disclosure. In FIG. 2, the appearance is illustrated in the left half of the drawing and an inner sectional view is illustrated in the right half of the drawing. As illustrated in FIG. 2, the example sealing arrangement 200 for bushing is a top sealing structure, which comprises a central conductor 201, a top cover 202, a guide element 203, and a protective cap 212.

Figure 3:
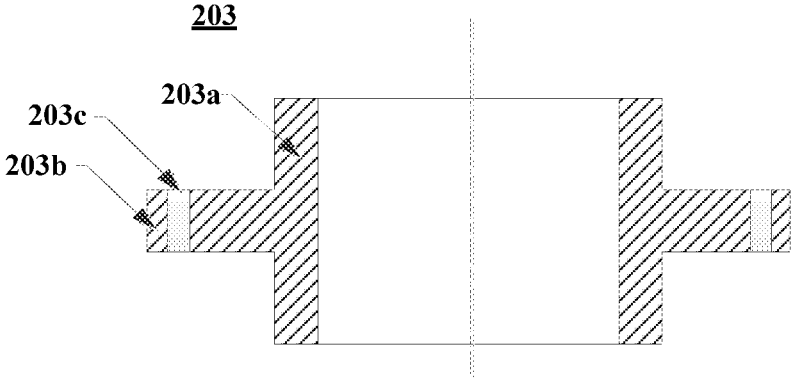
FIG. 3 schematically illustrates a sectional view of the guide element of FIG. 2 according to an embodiment of the present disclosure.

The central conductor 201 is a conductor for transferring the high-voltage power, which is usually made of copper. The top cover 202 is the top portion of the bushing. Specifically, for the dry-type bushing, the top cover 202 is the top plate of the expansion space; for a liquid-filled bushing, the top cover 202 is the top chamber of the bushing. The guide element 203 is arranged between the central conductor 201 and the top cover 202 and is connected onto the top cover 202 by bolts 206. As illustrated in FIG. 2, the central conductor 201 also goes through the guide element 203 and thus the guide element 203 is arranged between the central conductor 201 and the top cover 202 in the radial direction of the central conductor. The guide element 203 can be made of for example aluminum (AL). The guide element 203 is different from the cover plate 103 in the existing top structure, and in fact, they have different structures and different functions. Reference can be made to FIG. 3, which illustrates a sectional view of the guide element 203 according to an embodiment of the present disclosure.

As illustrated in FIG. 3, the guide element 203 have a cylinder portion 203*a* and a flange portion 203*b* extended from a middle part of the cylinder portion 203*a*. The cylinder portion 203*a* is the main body of the guide element 203 and the central conductor can go through the cylinder portion 203*a*. The guide element 203 further has installation holes 203*c* on the flange portion 203*b* and the guide element can be connected onto the top cover 202 by means of the installation holes 203*c* and bolts 206. Thus, different from the cover plate 103 in the existing top structure, the guide element have a cylinder body, which provide a possibility to design more effective sealing structure and provide a basis to address further problems, like electrochemical corrosion, and etc.

Figure 4:
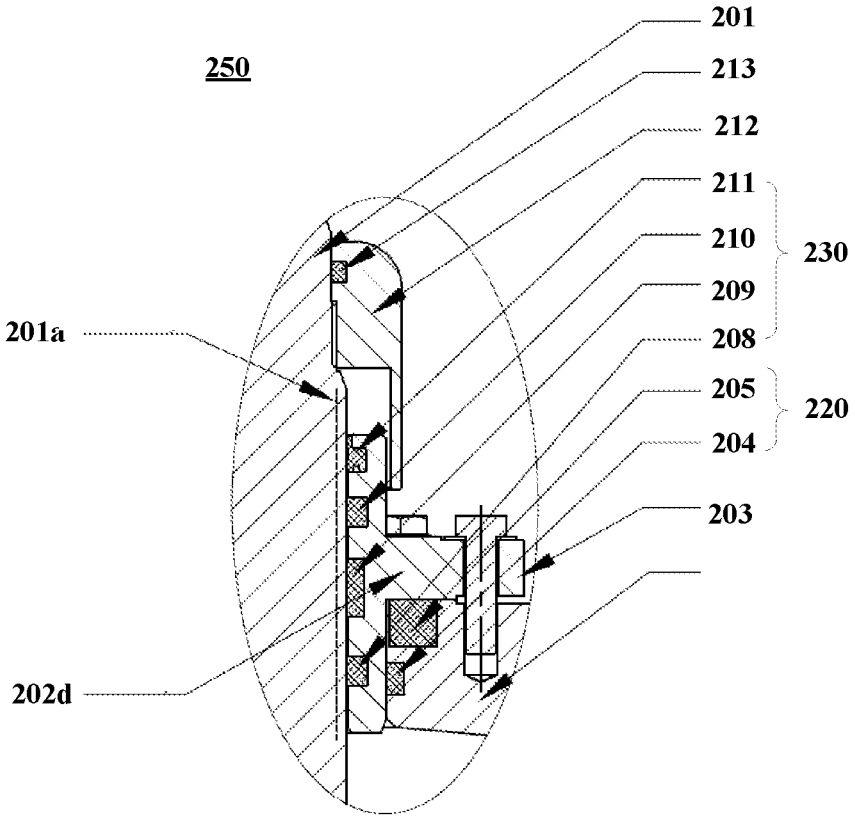
FIG. 4 schematically illustrates a partial sectional diagram of the sealing arrangement of FIG. 2 according to an embodiment of the present disclosure.

Referring back to FIG. 2, as illustrated, there is provided a new sealing structure 250. Partial enlarged view of the sealing structure 250 is further illustrated in FIG. 4. As illustrated in FIG. 4, the guide element 203 is connected onto the top cover 202 by bolts and there is arranged a static sealing structure 220 between the guide element 203 and the top cover 202. The static sealing structure includes an O-ring 204 and a gasket 205. The O-ring 204 is arranged between the guide element 203 and the top over 202. The gasket 205 is arranged between the guide element 203 and the top over 202 as well but located over the O-ring 204. Both the inner side and the top side of the gasket 205 are contacted with the guide element 203. The bolts 206 can connect the guide element 203 onto the top cover 202 by means of via holes in the guide element, which could effectively provide a sealing force. The O-ring 204 and the gasket 205 work together to provide a static sealing between the top cover 202 and the guide member 203. The O-ring 204 and the gasket 205 can be made of for example nitrile butadiene rubber (NBR), which can ensure a good sealing performance.

In addition to the static sealing structure 220, there is further provided a dynamic sealing structure 230 between the guide element 203 and the central conductor 201. The dynamic sealing structure 230 includes a first O-ring 208 and a second O-ring 210, which are arranged between the guide element 203 and the central conductor 201. The O-ring 208, 210 are arranged at the upper side and the lower side of flange portion 203*b*. The O-ring 208, 210 are used together to guarantee no leakage of top sealing structure. The O-rings 208, 210 can be made of for example Fluor silicone rubber/gum (FVMQ), NBR, poly tetra fluoroethylene (PTFE), or any other suitable material. Preferably, the O-rings are made from the FVMQ material since it has a better resistance to high temperature and low temperature, ranging from −40° C. to 120° C. and thus could provide desirable sealing performance. It shall be noticed that the number of O-rings can be less or more, which is dependent actual applicant requirements.

The dynamic sealing structure 230 may also comprise a wear ring 209 arranged between the guide element 203 and the central conductor 201. The wear ring 209 may be arranged between the two O-rings 208, 210. The wear ring 209 can be configured to provide anti-eccentricity and anti-wear properties. The wear ring 209 can be made of PTFE, FVMQ, NBR, or any other suitable material. Preferably, the wear ring 209 is made of PTFE due to its better wear resistance and self-lubricating properties. Due to such properties, the wear ring could reduce wear, especial wear of the sealing element due to an impact of tension load; and meanwhile it could provide enough tightening force, by means of the sealing force provided by the guide element, to hold the central conductor tightly, and therefore no eccentricity occurs even when relative movements occur between the central conductor and the guide element.

The dynamic sealing structure 230 may further comprise a wiper ring 211 arranged between the guide element 203 and the central conductor 201 at an upper portion of the guide element 203. The wiper ring 211 is used to seal the upper portion of the guide element so that the dust cannot enter gaps between the guide element 203 and the top cover 202. The wiper ring 211 may be made of for example polyurethane (PU), or any other material.

Above the upper portion of the guide element, the protective cap 212 is further provided. The protective cap 212 can be connected to the copper central conductor by, for example, threads. The protective cap 212 can be used to protect the sealing arrangement from the external environment, such as dust, rain, and snow. The protective cap 212 can be made of, for example, stainless steel, brass, aluminum, which could substantially reduce the electrical electrochemical corrosion between the central conductor and the protective cap 212. Between the central conductor 201 and the protective cap 212 is further arranged an O-ring to provide a further sealing therebetween. The O-ring could be made of chloroprene rubber (CR).

In addition, the central conductor 201 may have a chrome-plating surface 201*a*, especially at the area that abrasion is likely to happen. The chrome-planting of copper conductor surface can effectively prevent the copper conductor from abrasion. Further, the guide element may have an anodic oxidation surface 202*d*, especially at the contact between the guide element and the central conductor 201. The anodic oxidation for guide element surface can effectively prevent electrochemical corrosion between copper central conductor and aluminum guide element. The anodic oxide planting of aluminum guide element has an insulating effect and meanwhile it can also effectively prevent a virtual connection and unnecessary diversion circuit.

In order to verify the functionality of the sliding sealing arrangement to be used on high current bushings, the sealing arrangement 200 was tested through verification tests, which will be described hereinafter.

Sliding Cyclic Test

Figure 5:
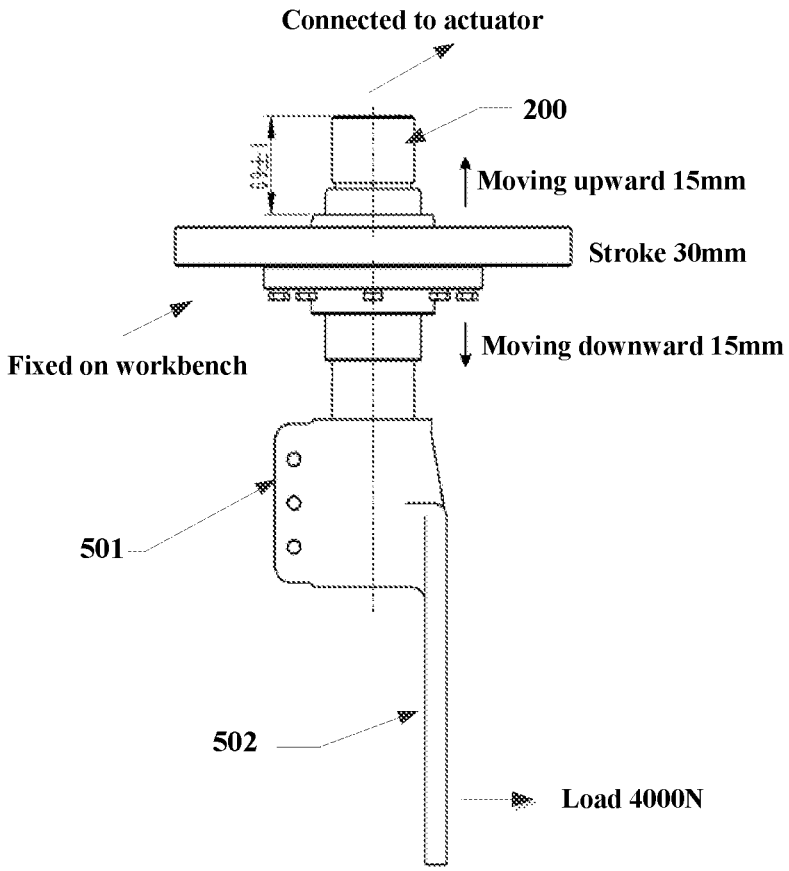
FIG. 5 schematically illustrates a testing system of the sealing arrangement according to an embodiment of the present disclosure.

FIG. 5 illustrates a test sliding mounting of the sealing arrangement 200. During the sliding cyclic test, a terminal plate 510 is clamped to a copper rod 520 for applying a cantilever load. The relative distance between the terminal plate 510 and sliding surface was kept the same as that for the bushing. A cycle for the test was defined as moving upward 15 mm from a neutral position, going back to the neutral position, then moving downward 15 mm and going back to the neutral position again. Thus, the stroke is 30 mm and a cycle travel is 60 mm.

The copper rod 502 was further connected to hydraulic actuator, by which a 3000N transversal load was continually applied to the sample sealing arrangement during sliding cyclic test to simulate a lateral force from wind. The test was performed with a cycle frequency of 0.33 Hz, i.e. at a moving speed of 20 mm/s. In addition, the sliding was performed twenty hundred times to simulate the sliding in thirty years of lifetime.

After the sliding cyclic test, tightness tests were further performed in 3 groups, the tightness tests include two kinds of tests, i.e., overpressure tightness tests, and tests on vacuuming helium for leakage.

Overpressure Tightness Test

During the over tests, the test sample was installed to a device which was firmly fixed to the ground, and a transversal load of 3000N was applied to terminal plate, filled with compressed air to the device by controlling the pressure up to 0.4 MPa, the inlet of the air was shut off and the pressure was maintained for 40 minutes. During the test, the joint interface with liquid soap and the change in pressure were observed.

Test conditions were listed as follows: 1) Ambient temperature: 23° C.; 2) Relative humidity: 60%. The overpressure tightness tests results are shown in Table 1.

TABLE 1

| Overpressure tightness tests | | | | |
|---|---|---|---|---|
| Groups | Pressure/MPa | Transvers load/N | Time/min | Leakage/Y/N |
| 1 | 0.4 | 3000 | 40 | N |
| 2 | 0.4 | 3000 | 40 | N |
| 3 | 0.4 | 3000 | 40 | N |

These results show that no any leakage was observed and no any pressure drop occurred, which means a good sealing performance.

Vacuuming Helium for Leakage Test

During the Vacuuming helium for leakage test, a test sample was installed to a test device, applied transversal load to the terminal plate, with the outlet of the test device connected to a helium mass spectrum leak detector, and vacuumed the test device, meanwhile continually jetting helium to the sealing interfaces.

During the leakage test, all 3 samples were applied to the transvers load of 3000N, and one of them was tested with transvers load of 4000N.

Test conditions are as follows: ambient temperature 23° C.; relative humidity: 60%. The vacuuming helium for leakage tests results are shown in Table 2.

TABLE 2

| Vacuuming helium for leaking tests | | | |
|---|---|---|---|
| Groups | Leakage levels/Pa · $m^3$/s | Transvers load/N | Leakage/Y/N |
| 1 | $1 \times 10^{-13}$ | 3000 | N |
| 2 | $1 \times 10^{-13}$ | 3000 | N |
| 3 | $1 \times 10^{-13}$ | 3000 | N |

These results show that no leakage was observed and no any pressure drop occurred, which means a good sealing performance.

Through the tests, it can be seen that the new top sliding sealing structure can effectively prevent eccentricity. Despite the frequent expansion of the rod, the tightness can be still guaranteed. Chrome-planting (copper conductor surface) can effectively prevent the copper conductor from abrasion. Anodic oxidation for guide's face can effectively prevent electrochemical corrosion between copper and aluminum, and meanwhile, the anodic oxide planting of aluminum has an insulating effect, it can effectively prevent the virtual connection and unnecessary diversion circuit. The entire sealing system is further protected by protection cap, which can effectively prevent the sliding sealing structure from dust, rain and snow erosion. Beside, despite the adoption of new structures and new materials, the cost has not increased significantly and the assembly is not complex either.

Therefore, unlike the traditional structure, the example sealing arrangement can not only be adapted for large changes in temperature, but also be used under bad conditions such as conductor eccentricity, large lateral load, sandstorm.

In another aspect of the present disclosure, there is also provided a bushing comprising a sealing arrangement 200 for the bushing as described hereinabove. The bushing can be for example transformer bushing, especially an oil-immersed paper transformer bushing.

It shall be noted that the example sealing arrangement is illustrated only for illustrative purposes and the present disclosure is not limited thereto. For example, in the illustrated dynamic sealing structure, there are two O-rings arranged above and under the wear ring respectively. In fact, the number of the O-rings can be less or more and the arrangement of the O-rings is not limited to the arrangement as illustrated. For another example, the illustrated example has various features to achieve corresponding advantages; however, these features can be use separately to achieve respective functionalities.

It shall also be noted that the present application is applicable to various bushings, like dry-type bushing, liquid-filled bushing. In addition, the bushing can be transformer bushing or wall bushing, or any other bushing to the OIP transformer bushing. The present application can be used in OIP transformer bushing but is not limited thereto.

Hereinabove, embodiments of the present disclosure have been described in details through embodiments with reference to the accompanying drawings. It should be appreciated that, while this specification contains many specific implementation details, these details should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Various modifications, adaptations to the foregoing exemplary embodiments of this disclosure may become apparent to those skilled in the relevant arts in view of the foregoing description, when read in conjunction with the accompanying drawings. Any and all modifications will still fall within the scope of the non-limiting and exemplary embodiments of this disclosure. Furthermore, other embodiments of the disclosures set forth herein will come to mind to one skilled in the art to which these embodiments of the disclosure pertain having the benefit of the teachings presented in the foregoing descriptions and the associated drawings.

Therefore, it is to be understood that the embodiments of the disclosure are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A sealing arrangement of a bushing for a power electrical device, comprising:

a top cover;

a central conductor going through the top cover;

a guide element having a cylinder portion and a flange portion extended from a middle part of the cylinder portion, wherein the cylinder portion is arranged between the top cover and the central conductor and the flange portion is connected onto the top cover;

a static sealing structure provided between the guide element and the top cover; and a dynamic sealing structure provided between the guide element and the central conductor, wherein the dynamic sealing structure comprises two dynamic sealing O-rings between the guide element and the central conductor and a wear ring arranged between the two dynamic sealing O-rings.

2. The sealing arrangement of claim 1, wherein each of the two dynamic sealing O-rings is made of fluorine silicone rubber.

3. The sealing arrangement of claim 1, wherein the wear ring is made of poly tetra fluoroethylene.

4. The sealing arrangement of claim 1, wherein the dynamic sealing structure further comprises a wiper ring arranged between the guide element and the central conductor at an upper portion of the guide element.

5. The sealing arrangement of claim 4, wherein the wiper ring is made of polyurethane.

6. The sealing arrangement of claim 1, further comprising a protective cap covering a top portion of the guide element to protect the sealing arrangement from an external environment and wherein the central conductor goes through the protective cap.

7. The sealing arrangement of claim 6, further comprising a further O-ring arranged between the protective cap and the central conductor.

8. The sealing arrangement of claim 7, wherein the further O-ring is made of chloroprene rubber (CR).

9. The sealing arrangement of claim 1, wherein the central conductor has a chrome-plating surface.

10. The sealing arrangement of claim 1, wherein the guide element has an anodic oxidation surface.

11. The sealing arrangement of claim 1, wherein the static sealing element comprises a static sealing O-ring and a gasket arranged between the guide element and the top cover, and wherein one or both of the static sealing O-ring and the gasket is made of nitrile butadiene rubber.

12. A bushing for a power electrical device comprising a sealing arrangement for the bushing according to claim 1.

13. The bushing for a power electrical device of claim 12, wherein the bushing is a transformer bushing.

14. The bushing for a power electrical device of claim 13, wherein the transformer bushing is an oil-immersed paper transformer bushing.

15. The bushing for a power electrical device of claim 12, wherein the bushing is a wall bushing.

16. The bushing for a power electrical device of claim 12, wherein the bushing is a dry-type bushing.

17. The bushing for a power electrical device of claim 12, wherein the bushing is a liquid filled bushing.

* * * * *